US005992454A

United States Patent [19]

Schrag

[11] Patent Number: 5,992,454

[45] Date of Patent: Nov. 30, 1999

[54] LOWER AND FLOAT CAPABILITY IN FOUR POSITION CONTROL VALVE

[75] Inventor: Jerry D. Schrag, Savage, Minn.

[73] Assignee: Eaton Corporation, Cleveland, Ohio

[21] Appl. No.: 09/120,352

[22] Filed: Jul. 21, 1998

[51] Int. Cl.[6] ..... F15B 13/04

[52] U.S. Cl. ..... 137/596.2; 91/447

[58] Field of Search ..... 91/447, 464; 137/596.2

[56] References Cited

U.S. PATENT DOCUMENTS

| | | | |
|---|---|---|---|
| 2,949,097 | 8/1960 | Vander Kaay . | |
| 3,613,508 | 10/1971 | Krehbiel et al. | 91/464 X |
| 3,746,040 | 7/1973 | Paul | 137/596 |
| 4,088,151 | 5/1978 | Schurger | 91/447 X |
| 4,290,447 | 9/1981 | Knutson | 91/464 X |
| 4,569,273 | 2/1986 | Anderson et al. | 91/447 |
| 4,782,859 | 11/1988 | Constantinian | 91/464 X |

*Primary Examiner*—Gerald A. Michalsky
*Attorney, Agent, or Firm*—L. J. Kasper

[57] ABSTRACT

A spool valve assembly (11) including a valve spool (33) defining a Raise position (R) operable to provide fluid communication from an inlet port (21) to a work port (25), and a Neutral position (N) blocking such flow. The spool valve (33) has a Lower position (L) in which return flow from the work port (25) flows past a pilot operated check valve (77) is then metered by a metering notch (75) defined by the valve spool. The valve spool (33) also has a separate Float position (F) in which the inlet port (21), the work port (25) and the return port (23) are interconnected. In the Float position (F), fluid at the valve spool (33) is in communication with the return port (23) through a back-pressure valve (59), which may be manually adjusted to control the back-pressure on a work implement (15) as it is permitted to "float".

4 Claims, 4 Drawing Sheets

LOWER AND FLOAT CAPABILITY IN FOUR POSITION CONTROL VALVE

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

The present invention relates to flow control valves, and more particularly, to such valves which are provided with a "Float" position.

More specifically, the present invention relates to a spool valve which is able to control the flow of fluid from a source, such as a pump to a work port, wherein the flow to the work port is through a pilot operated check valve, and the invention will be described in connection therewith.

Many flow control valves of the type to which the present invention relates are utilized to control the flow of pressurized fluid from a source to a work implement, such as a cylinder, which is used in association with a piece of equipment which, under certain operating conditions, is allowed to "float". An example of such a system would be the mower deck on a large, commercial turf maintenance vehicle. The mower deck is mounted such that its mowing height is controlled by a cylinder, of which the upper chamber is vented to air, and the lower chamber is connected to a three way, three-position flow control spool valve. Typically, the spool valve is provided with three operating positions, including (1) Raise; (2) Neutral; and (3) Lower or Float.

As is well known to those skilled in the art, the Float position of the spool valve is one in which the inlet port (connected to the pump), the work port (connected to the cylinder lower chamber), and the return port (connected to tank) are all interconnected, thus permitting the implement (e.g., the mower deck), to have some vertical movement (i.e., to float) in response to external loads imposed upon the implement.

Many such flow control valves have been provided with pilot operated load holding check valves, the function of which, as is well known to those skilled in the art, is to prevent flow from the lower chamber of the cylinder back through the work port when the spool valve is in the Neutral position, and there is a load on the cylinder. Typically, the load holding check valve has been operably associated with a lockout plunger, the function of which is to hold the check valve open, thus permitting lowering of the cylinder, when high pressure is exerted on the plunger.

Although the above-described flow control valve has been generally satisfactory, the sequence of steps for lowering the cylinder has not been fully satisfactory. In order to lower the load with the prior art flow control valve, the operator would first move the spool to the Lower position, thus permitting lowering of the load, and then when the load was at approximately the desired position, the operator would move the spool to the Raise position. The movement of the spool to the Raise position was required because the lockout plunger was typically equipped with a detent which, after the plunger was subjected to high pressure, was held in the position corresponding to the open position of the check valve. Therefore, it was necessary to move the spool to the Raise position to exert high pressure on the lockout plunger, but now in the opposite direction, to move it out of engagement with the detent and back to its normal position. This movement of the lockout plunger would permit the check valve to close, thus cutting off the return flow of fluid from the implement. The operator would then move the spool to the Neutral position, thus maintaining the load in whatever position it occupied at that time.

Although the above sequence of steps resulted in generally satisfactory operation, the particular sequence of steps would not seem natural to the operator, and in an emergency, when the operator may not have the opportunity to think through the required sequence, it is possible that the operator will not provide input movement to the valve spool which is appropriate for that particular situation.

BRIEF SUMMARY OF THE INVENTION

Accordingly, it is an object of the present invention to provide an improved spool valve assembly which overcomes the problems of the prior art valve assemblies.

It is a more specific object of the present invention to provide such an improved spool valve assembly in which it is possible to lower an implement simply by putting the valve spool in its Lower position, wherein the return flow in the Lower mode is metered, such that the operator has effective control of the implement position in the Lower mode.

It is a related object of the present invention to provide an improved spool valve assembly which accomplishes the above-stated objects and which has, separate from the Lower mode, a Float position, in which the implement is generally free to move upward and downward in response to external loads being applied to the implement.

The above and other objects of the invention are accomplished by the provision of a spool valve assembly having a housing including a pressure inlet port, a return port, and a work port. A valve spool is moveable within the housing and defines a Raise position operable to provide fluid communication from the inlet port to the work port, a Neutral position operable to block fluid communication from the inlet port to the work port while providing fluid communication from the inlet port to the return port. Also included is a Float position in which the inlet port, the work port and the return port are interconnected. A pilot operated check valve assembly includes a check valve member disposed upstream of the work port whereby, when the valve spool is in the Raise position, pressurized fluid flows from the inlet port, opening the check valve member, to the work port.

The improved spool valve assembly is characterized by the valve spool defining a Lower position, disposed axially between the Neutral position and the Float position. In the Lower position, the valve spool provides fluid communication from the inlet port to bias the pilot operated check valve assembly to open the check valve member, while the valve spool meters fluid flow from the work port, past the open check valve member, and past the valve spool to the return port.

DETAILED DESCRIPTION OF THE PREFERRED EMBODIMENT

Figure 1:
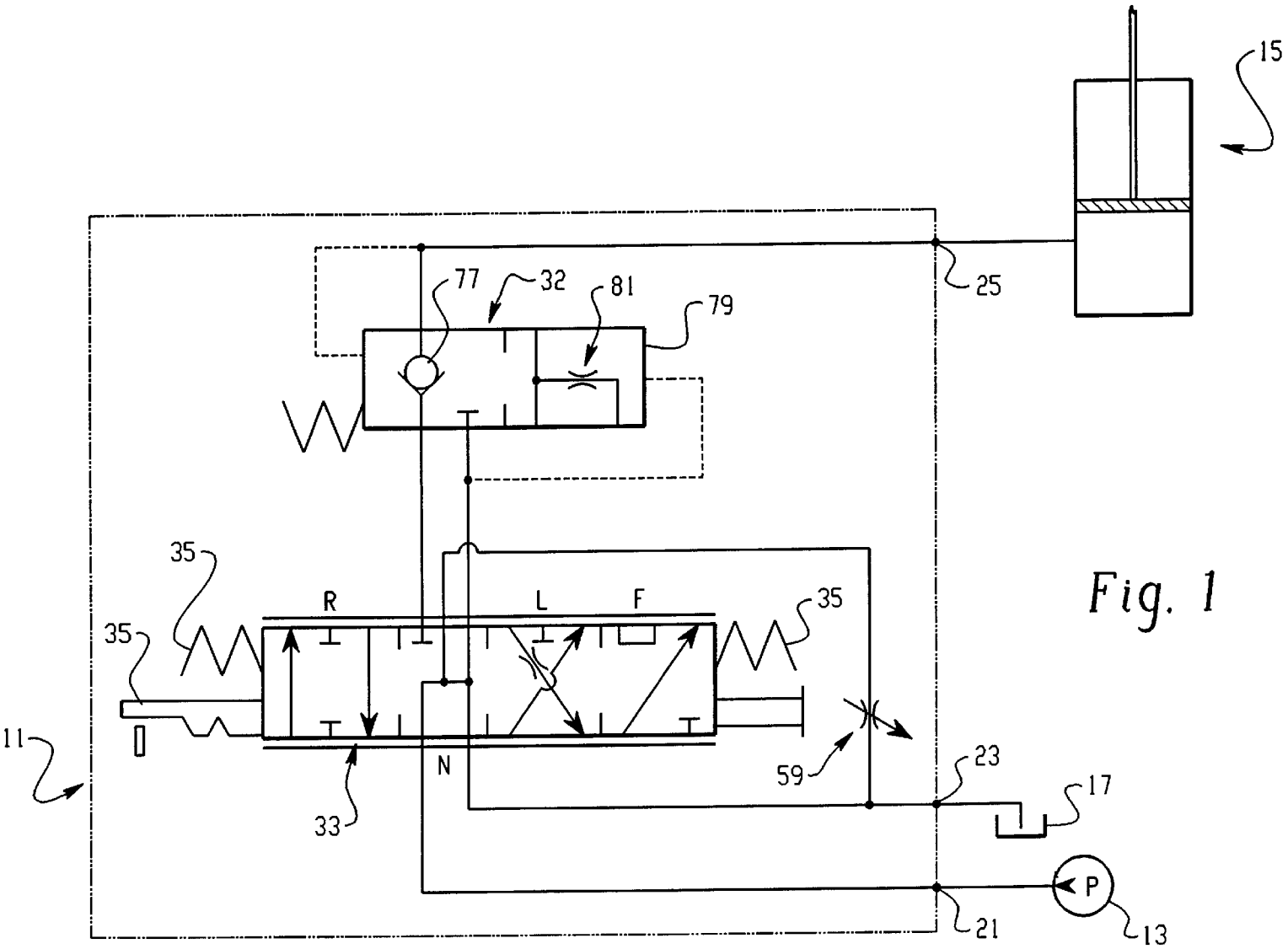
FIG. 1 is a hydraulic schematic of a vehicle work circuit of the type utilized in the spool valve of the present invention.
Figure 2:
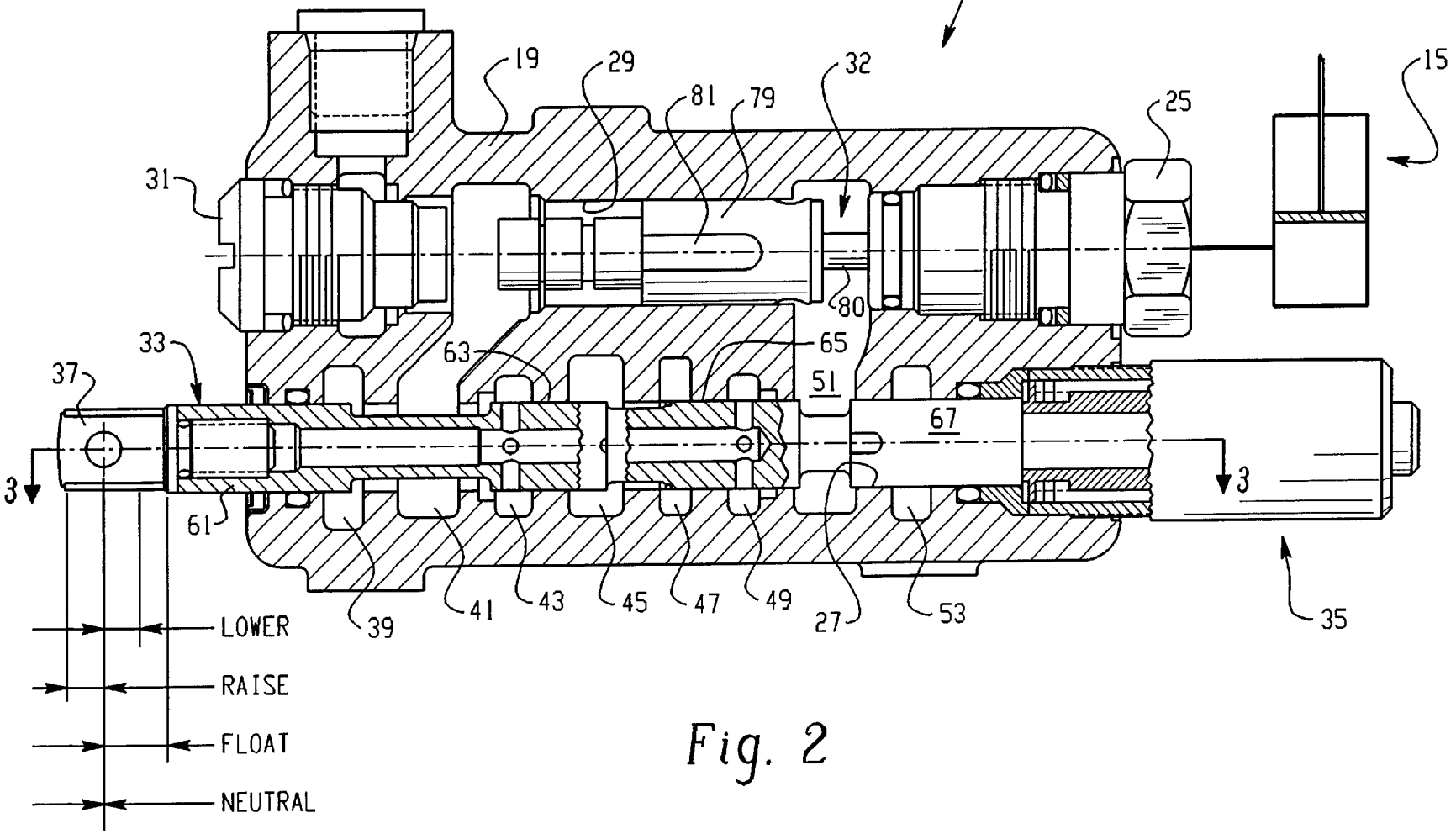
FIG. 2 is an axial cross-section of the spool valve of the present invention, shown in the Neutral position of the spool valve.
Figure 3:
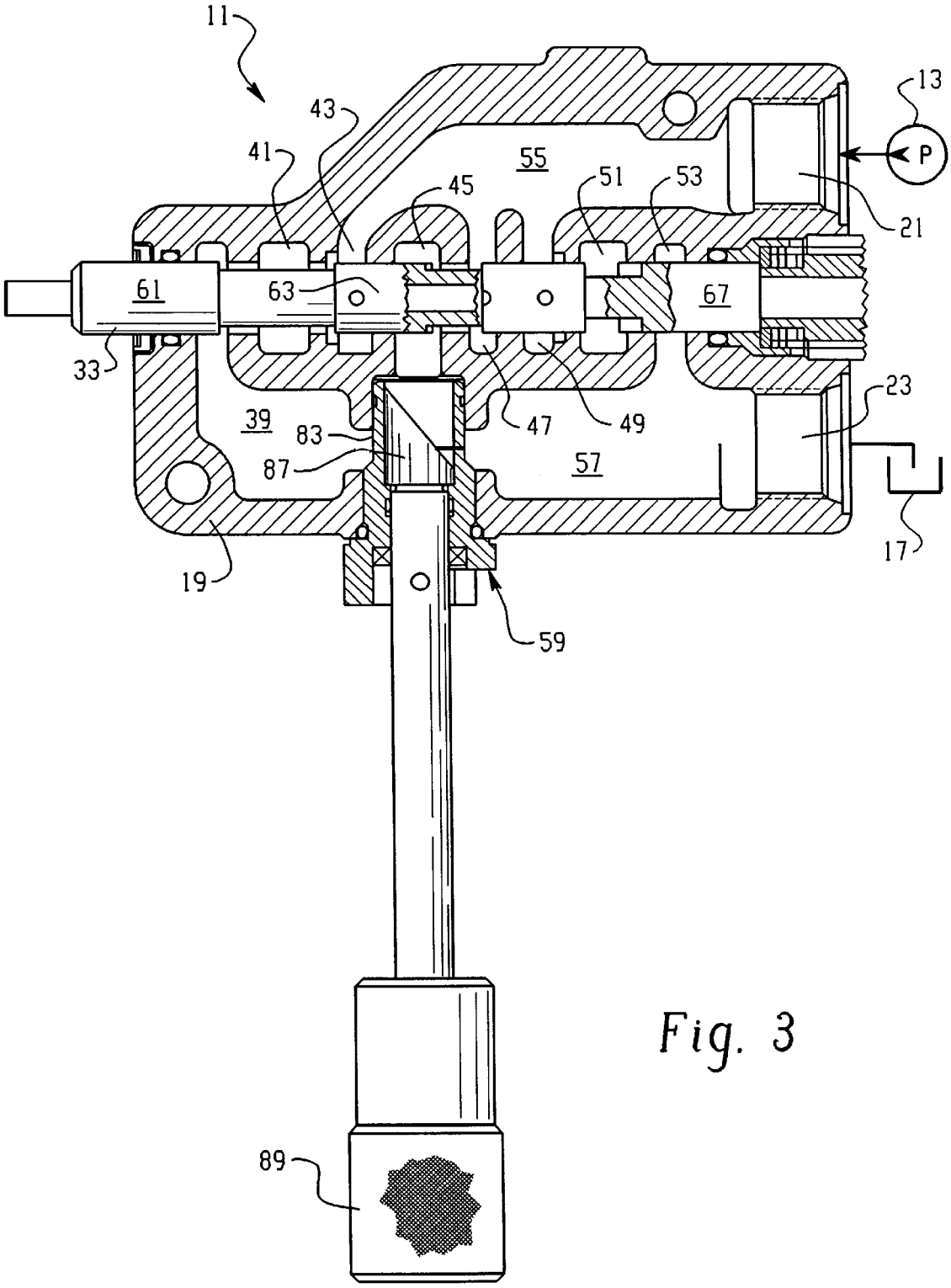
FIG. 3 is an axial cross-section taken on line 3—3 of FIG. 2, and showing the back pressure valve which comprises one aspect of the present invention.

Referring now to the drawings, which are not intended to limit the invention, FIG. 1 illustrates a hydraulic schematic of a work circuit utilizing the spool valve assembly of the present invention, the spool valve assembly being generally designated 11. Referring now also to FIGS. 2 and 3, the spool valve assembly 11 controls the flow of pressurized fluid from a source, shown herein as a fixed displacement pump 13, to either a work implement, shown herein as a cylinder 15, or to a system reservoir 17.

Referring now primarily to FIGS. 1 and 3, the spool valve assembly 11 includes a valve housing 19, which is typically a cored casting, the housing 19 defining a fluid inlet port 21, a fluid return port 23, and a work port 25, shown in FIG. 2 as a fitting. The valve housing 19 defines a pair of spool bores 27 and 29, with the bore 29 being sealed at its opposite ends by the fitting 25 which comprises the work port and by a threaded fitting 31. Also disposed within the spool bore 29 is a pilot operated check valve assembly, generally designated 32. Disposed within the spool bore 27 is a valve spool 33 having, at its right end, a centering spring and detent assembly, generally designated 35, which forms no part of the present invention and because it is generally well known to those skilled in the art, is shown only in external plan view, and will not be described further herein. The valve spool 33 also includes, at its left end, a portion 37 which is suitable for connection to some sort of control linkage (not shown herein) which also forms no part of the present invention.

Intersecting the spool bore 27 are a plurality of cast corings, including, from left to right in FIGS. 2 and 3, corings 39; 41; 43; 45; 47; 49; 51; and 53. As may best be seen in FIG. 3, corings 43, 47 and 49 are all interconnected with each other, and by means of a cored passage 55, are in open communication with the inlet port 21.

The corings 39 and 53 are in open communication with each other, and by means of a cored passage 57, are in open communication with the return port 23. The corings 41 and 51 also intersect the spool bore 29, for reasons which will be described subsequently. Finally, the coring 45 is associated with a back pressure valve assembly, generally designated 59, the function of which will also be described subsequently.

Referring now to any one of FIGS. 2 through 5, the valve spool 33 includes a plurality of lands 61, 63, 65 and 67. The valve spool 33 also defines an elongated bore or passage 69 which is in fluid communication with the surface of the land 63 by means of a plurality of radial passages 71, and which is in fluid communication with the surface of land 65 by means of a plurality of radial passages 73. Finally, the land 67 defines a metering notch 75, the function of which will be described subsequently.

Referring now primarily to FIGS. 1 and 2, the pilot operated check valve assembly includes a check valve 77 (shown only in FIG. 1) but which would typically be disposed either within or immediately upstream of the fitting 25. The check valve assembly 32 also includes a lockout plunger 79, which is axially moveable within the spool bore 29, to the right in FIG. 2, to lift the check valve member 77 off its seat by means of a rod-like member 80, and permit return flow from the cylinder 15 in a manner well known to those skilled in the art. The plunger 79 defines an axially extending metering notch 81, the function of which will be described in connection with the Lower and Float modes of operation.

Figure 5:
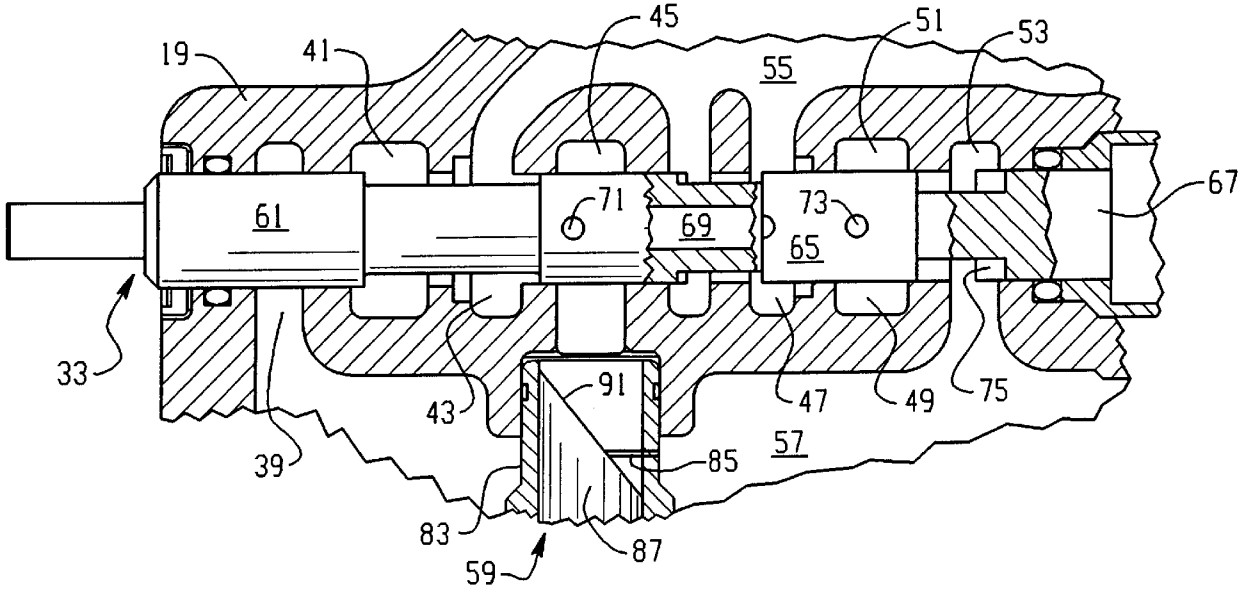
FIG. 5 is an enlarged, fragmentary, axial cross-section, similar to FIG. 3, illustrating the spool valve in the Float position.

Referring now primarily to FIGS. 3 and 5, the back pressure valve assembly 59 comprises a cylindrical housing member 83, which may comprise part of a threaded plug, and the wall of the housing member 83 defines a slot 85 (see FIG. 5) which extends about a portion of the circumference of the housing 83. In the subject embodiment, and for reasons which will be explained subsequently, the slot 85 has a circumferential extent of about 130°. Disposed within the housing 83 is a rotatable spool 87, which may be manually rotated by means of a handle 89. The spool 87 defines an angled surface 91, such that the rotational orientation of the spool 87 determines how much of the slot 85 is covered by the spool 87, and how much of the slot is "exposed", and therefore, in open fluid communication with the coring 45. As may best be seen in FIG. 5, any fluid which flows from the coring 45 to the interior of the housing member 83 will then flow through whatever portion of the slot 85 is exposed and from there will flow through the cored passage 57 to the system reservoir 17.

Operation

Referring now primarily to FIGS. 1 and 2, the operation of the spool valve assembly 11 will be described. Various aspects of the operation are conventional and well-known, but those aspects of the invention which are significant will be noted.

With the valve spool 33 in the Neutral position shown in FIGS. 1 and 2, pressurized fluid entering the inlet port 21 flows into the corings 43, 47 and 49, but in the Neutral position, the coring 43 is in open communication through the coring 41, to the coring 39, which is in open communication with the system reservoir as noted previously. Therefore, although the schematic of FIG. 1 shows that flow out of the valve spool 33 is also passing through the back pressure valve assembly 59, those skilled in the art will understand that fluid flow will actually take the "path of least resistance" and flow through the coring 39 to the system reservoir. As a result there will not be a high neutral flow pressure differential across the valve assembly 11, which would, in most cases, be undesirable.

When the operator wishes to raise the cylinder 15, it is necessary to move the valve spool 33 to the right in FIG. 1, but to the left in FIGS. 2 through 5. In the Raise position of the valve spool 33, pressurized fluid entering the inlet port 21 flows into the coring 43, which is now blocked by the land 63, and into the coring 47, which is now blocked by the land 65. However, pressurized fluid also flows into the coring 49, and with the spool valve 33 in the Raise position, the land 65 is moved far enough to the left in FIG. 2 to open up communication between the coring 49 and the coring 51. Therefore, pressurized fluid flows through the coring 51 and unseats the check valve member 77, and flows through the work port 25 to the cylinder 15. The operation described up to this point is fairly conventional.

Figure 4:
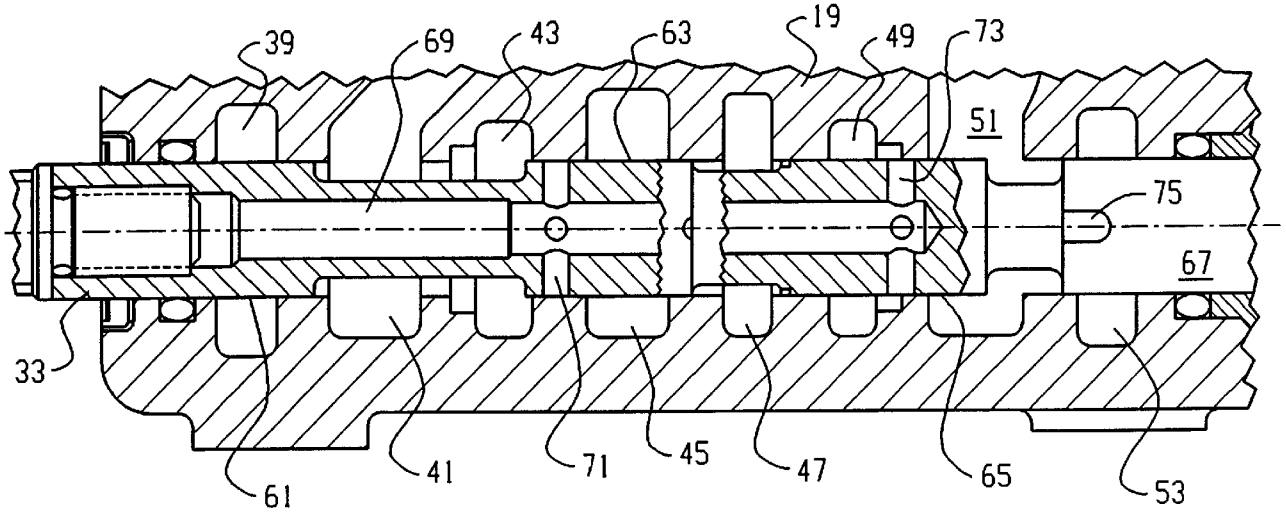
FIG. 4 is an enlarged, fragmentary, axial cross-section, similar to FIG. 2, showing the spool valve in the Lower position.

When it is desired to lower the cylinder 15, the operator moves the valve spool 33 to the left in FIG. 1, but to the right in FIG. 2 until the valve spool is in the position shown in FIG. 4. In the Lower position, pressurized fluid is again communicated from the inlet port 21 to the corings 43, 47 and 49, and because the coring 43 is in open communication with the coring 41, pressurized fluid acts on the left end (in FIG. 2) of the lockout plunger 79, biasing the plunger 79 to the right in FIG. 2, unseating the check valve member 77 by means of the rod-like member 80. With the check valve member 77 open, fluid in the lower chamber of the cylinder 15 can return through the work port 25, past the open check valve member 77 and into the coring 51. With the valve spool 33 in the Lower position of FIG. 4, the land 67 has moved far enough to the right that the metering notch 75 provides open, but restricted, communication between the coring 51 and the coring 53. Thus, the cylinder 15 is lowered, but in a controlled fashion.

When operating in the Lower mode, the operator may move the valve spool to vary the area of the metering notch 75 and manually "meter" the lowering of the cylinder 15. Alternatively, the size and location of the metering notch 75 may be selected such that the valve spool 33 can be placed in a fixed, position (Lower) and the cylinder 15 will lower at a predetermined rate. In this mode (and also in the Float mode), the purpose of the metering notch 81 is to permit a flow from the coring 41 to the coring 51, thus creating a pressure drop across the lockout plunger 79, and preventing a build-up of excessive pressure in the coring 41, which would typically unseat the system relief valve.

When it is desired to allow the cylinder 15 to operate in a Float mode, the operator moves the valve spool 33 further to the left in FIG. 1, but further to the right in FIG. 2, to the position shown in FIG. 5. With the valve spool 33 in the Float position of FIG. 5, fluid entering the inlet port 21 again flows to the corings 43, 47 and 49, and, as was the case in the Lower position, pressurized fluid flows from the coring 43 through the coring 41, biasing the lockout plunger 79 to the right in FIG. 2, and opening the check valve member 77. Therefore, in the Float position, the fluid in the cylinder 15 can flow through the work port 25 and past the check valve member 77 into the coring 51. The land 65 now blocks direct communication from the coring 51 to the coring 53. Instead, fluid in the coring 51 communicates by means of the radial passages 73, through the elongated passage 69, and out the radial passages 71 into the coring 45. In general, the coring 45 is in communication by means of the passage 57 with the system reservoir 17 such that, in the Float position, the inlet port, the work port and the return port are all more or less interconnected.

In accordance with another important aspect of the present invention, the operator can manually adjust the back pressure valve assembly 59 to "fine tune" the degree to which the cylinder is allowed to float. For example, if the cylinder 15 is controlling a mower deck, and the deck is not following the contour of the land sufficiently, the operator can rotate the spool 87 to expose more of the slot 85, thus reducing the back pressure and making the mower deck more responsive to external forces. Conversely, if the mower deck is moving excessively in response to external forces, the spool 87 can be rotated to block off more of the slot 85, reducing the flow of fluid from the coring 45 to the return port 23 (effectively increasing the back pressure).

Although the invention has hereinabove been described with respect to the illustrated embodiments, it will be understood that the invention is capable of modification and variation and is limited only by the following claims.

I claim:

1. A spool valve assembly having a housing including a pressure inlet port, a return port, and a work port; a valve spool moveable within said housing and defining a Raise position operable to provide fluid communication from said inlet port to said work port, a Neutral position operable to block fluid communication from said inlet port to said work port, while providing fluid communication from said inlet port to said return port, and a Float position in which said inlet port, said work port, and said return port are in relatively unrestricted fluid communication with each other; a pilot operated check valve assembly including a check valve member disposed upstream of said work port whereby, when said valve spool is in said Raise position pressurized fluid flows from said inlet port, opening said check valve member, to said work port; characterized by:

(a) said valve spool defining a Lower position, disposed axially between said Neutral position and said Float position;

(b) in said Lower position, said valve spool provides fluid communication from said inlet port to bias said pilot operated check valve assembly to open said check valve member, while said valve spool meters fluid flowing from said work port, past said open check valve member, and past said valve spool to said return port; and (c) a back pressure valve disposed in series flow relationship between said valve spool and said return port when said valve spool is in said float position, said back pressure valve including manually actuatable means for moving said back pressure valve between a relatively restricted position and a relatively unrestricted position.

2. A spool valve assembly as claimed in claim 1, characterized by said pilot operated check valve assembly includes a plunger member operable, in response to the presence of pressurized fluid from said inlet port to move to an actuated position in which said check valve member moves to an open position.

3. A spool valve assembly as claimed in claim 2, characterized by said plunger member defines a fluid passage operable to communicate pressurized fluid from said inlet port to a location joining said fluid flowing from said work port, past said open check valve member to said return port.

4. A spool valve assembly having a housing including a pressure inlet port, a return port, and a work port; a valve spool moveable within said housing and defining a Raise position operable to provide fluid communication from said inlet port to said work port, a Neutral position operable to block fluid communication from said inlet port to said work port, while providing fluid communication from said inlet port to said return port, and a Float position in which said inlet port, said work port, and said return port are in relatively unrestricted fluid communication with each other; a pilot operated check valve assembly including a check valve member disposed upstream of said work port whereby, when said valve spool is in said Raise position pressurized fluid flows from said inlet port, opening said check valve member, to said work port; characterized by:

(a) a back pressure valve disposed in series flow relationship between said valve spool and said return port when said valve spool is in said Float position, said back pressure valve including manually actuatable means for moving said back pressure valve between a relatively restricted position and a relatively unrestricted position; and (b) said valve spool being configured such that fluid returning from said work port flows to said valve spool, then through said back pressure valve to said return port.

* * * * *